US005367887A

United States Patent [19]

Byrd et al.

[11] Patent Number: 5,367,887

[45] Date of Patent: Nov. 29, 1994

[54] APPARATUS FOR FROSTING DRINKING GLASSES

[76] Inventors: Jerry Byrd, 471 Ashwood Pl., Boca Raton, Fla. 33431; Michael O'Donnell, 124 E. Central Blvd., Lantana, Fla. 33461

[21] Appl. No.: 125,324

[22] Filed: Sep. 22, 1993

[51] Int. Cl.[5] ..... F25D 23/10

[52] U.S. Cl. ..... 62/266; 62/378; 62/457.9

[58] Field of Search ..... 62/258, 266, 337, 378, 62/380, 340, 457.9

[56] References Cited

U.S. PATENT DOCUMENTS

| | | | |
|---|---|---|---|
| 1,878,198 | 9/1932 | Souther | 62/380 X |
| 2,250,557 | 7/1941 | Tull | 62/380 |
| 3,267,585 | 8/1966 | Futer | 62/380 X |
| 3,373,579 | 3/1968 | Federighi | 62/293 |
| 3,407,624 | 10/1968 | Taylor | 62/293 |
| 3,431,749 | 3/1969 | Bounds | 62/293 |
| 3,602,008 | 8/1971 | Kelley | 62/373 |
| 3,668,888 | 6/1972 | Roslonski | 62/373 |
| 4,237,697 | 12/1980 | Cherbland | 62/293 |
| 4,351,157 | 9/1982 | Zeigler | 62/340 X |
| 5,018,360 | 5/1991 | Jones | 62/340 X |

*Primary Examiner*—William E. Tapolcai
*Attorney, Agent, or Firm*—McHale & Slavin

[57] ABSTRACT

The instant invention is directed to an apparatus for frosting drinking glasses. The apparatus is a self contained flash freezer designed for placement on a countertop wherein a miniaturized refrigeration system is mounted directly above a flash freezing chamber. Drinking glasses are placed upon a sloped roller bed used for transferring of the drinking glasses which are subjected to temperatures of about −30 degrees Fahrenheit causing frosting of the drinking glasses in less than one minute. The frosted glasses can be removed from a second opening of the chamber disposed at the lower end of the sloping roller bed. During normal operation, the apparatus is sized to handle a number of glasses and the sloped roller bed permits insertion of untreated drinking glasses which in turn forces the exit of frosted drinking glasses. For optimum frosting the apparatus accepts wet drinking glasses as the roller bed permits excess water to fall on a defrosting pan designed to vaporize excess moisture within the chamber for controlling the amount of frosting applied to the drinking glasses.

15 Claims, 6 Drawing Sheets

APPARATUS FOR FROSTING DRINKING GLASSES

BACKGROUND OF THE INVENTION

1. Field of the Invention

This invention relates generally to the freezing of containers and, more particularity, to an apparatus for use in flash freezing of drinking glasses.

2. Description of the Prior Art

Patrons to restaurants and drinking establishments have become accustomed to the use of frosted drinking glasses for holding such beverages as beer, cola, mixed drinks and so forth. Typically, frosting of a drinking glass is performed by placing the drinking glass in a freezer for at least 30 minutes, preferably overnight, and withdrawing the drinking glass when needed. A problem with conventional freezer employment is the need for custom shelving must be installed within the freezer to provide proper arrangement in that the frosted glasses can be removed while unfrosted glasses can be inserted for treatment. Thus, the arrangement within the freezer must be systematic so that the insertion of a warm glass will not be placed next to a fully frosted glass as the warmth will melt the frost. Not only is the aforementioned arrangement difficult to orchestrate, those who work in such establishments fully understand that access to the freezer by more than one person makes continued organization nearly impossible.

In most drinking establishments, a conventional chest freezer is utilized for frosting of beer mugs. The chest freezers are over three feet wide and five feet long having a top that is either hinged or custom designed using sliding sectional sections. The physical size of the freezer makes it necessary to position on the floor wherein the top of the freezer is actually used as part of the countertop. In operation, an employee bends over the freezer opening to reach into the freezer every time a frosted mug is retrieved or inserted into the freezer. If the establishment is busy, the operator may bend over the freezer several hundred times a day leading to obvious back problems. In addition, the opening of a larger freezer door to obtain a single drinking glass is inefficient as a large volume of cool air will escape every time the freezer door is opened.

Large freezers are not capable of efficiently flash freezing requiring the drinking glasses to remain overnight if a hard frost is desirous and the establishment must carry a large number of drinking glasses. Further, the more freshly washed glasses returned to the freezer, the higher the risk that the warm glasses will ruin the previously frosted glasses by melting or otherwise softening the frost. Finally, a conventional freezer is not capable of adjusting the amount of frost on the drinking glasses and is otherwise ill suited for treating small numbers of drinking glasses.

A number of attempts have been made for frosting individual drinking glasses. The problem with such art is that the majority of devices are designed for use with liquid refrigerant that is directed across the surface of the container causing rapid condensation and formation of ice. Such release of refrigerant is dangerous to the operator as it is capable of freezing human flesh upon contact. In addition, a number of devices use Freon R-12 refrigerant which has been linked to the depletion of the ozone layer causing most nations to severely regulate the release of the gas.

U.S. Pat. No. 3,373,579 issued to Federighi discloses a portable device for chilling containers by spraying pressurized liquid refrigerant onto the surface of the container. U.S. Pat. No. 3,407,624 issued to Taylor discloses yet another device for chilling containers by the use of liquid refrigerant spraying onto the surface of the container. U.S. Pat. No. 3,431,749 issued to Bounds et al., discloses still another device for chilling containers by the use of liquid refrigerant such as Freon or carbon dioxide onto the surface of the container. U.S. Pat. No. 3,602,008 issued to Kelley discloses a glass frosting device that frosts both the inner and outer surface of the container by the dispersion of carbon dioxide. U.S. Pat. No. 3,668,888 issued to Roslonski discloses yet still another glass frosting device by the controlled dispersion of carbon dioxide. U.S. Pat. No. 4,237,697 issued to Cherbland discloses an apparatus for frosting drinking glasses by directing carbon dioxide in a liquid-gaseous state to the inner surface of a container causing the internal cooling of the latter and the formation of the frost by adding air moisture which freezes to the outer surface of the container.

While there have been a number of attempts to frost drinking glasses, the prior art lacks an apparatus that is small enough to place upon a countertop, as quick as spraying refrigerant directly onto a container, capable of providing layers of frost, and friendly to the environment in terms of energy efficient and reusable. It is, therefore, to the effective resolution of these needs and problems associated therewith that the present invention is directed.

SUMMARY OF THE INVENTION

The instant invention is a flash freezer developed solely for the purpose of frosting drinking glasses. The apparatus is designed for placement on a countertop preferably next to a rinsing sink wherein the moment a drinking glass is washed, the glass can be inserted into the apparatus in a moist state. During operation, when one drinking glass is inserted into a freezing chamber of the apparatus, a frosted glass is forced out.

Use of the instant invention allows the immediate reuse of drinking containers in a frosted state. For instance, in a typically drinking establishment such as a tavern, there is a limited amount of beer mugs requiring the proprietor to reuse the mugs immediately after use. However, the immediate return to service of such mugs does not provide subsequent patrons the benefit of receiving a frosted beer mug. Thus, either the establishment is forced to purchase a large number of mugs and a large freezer, or the establishment will only be able to provide a limited number of frosted beer mugs during the day.

The apparatus employs a spaced apart sloped roller bed for transferring drinking containers through a freezing chamber. The freezing chamber provides temperatures of about −30 degrees Fahrenheit causing flash freezing of the drinking glass in less than one minute. The frosted drinking glass is removed from a second opening disposed at the lower end of the sloping roller bed. During normal operation, the apparatus is sized to handle a number of drinking glasses and the sloped roller bed permits ease of removal as insertion of untreated drinking glasses forces the exit of frosted drinking glasses. For optimum frosting the apparatus accepts wet drinking glasses wherein the roller bed permits excess water to fall on a condenser pan using a defrosting coil which in turn provides an adjustable amount of water vapor to be returned to the freezing chamber. The higher the amount of water vapor returned to the chamber, the more thickly frosted drinking glasses will be obtained.

An insertion end of the apparatus utilizes insulated hanging vinyl strips that are easily moved for insertion of a single drinking glass. If the freezing chamber is full, a loading platform is provided for placement of additional glasses, the platform provides water drainage into the heated coil area for increasing the vapor moisture content of the chamber.

A second end wall of the apparatus provides an opening for removal of the frosted drinking glasses also employing insulated hanging vinyl strips that are easily moved for removal of the frosted containers. If the freezing chamber is full, the loading of a single drinking glass at the insertion end will cause the expulsion of a frosted container. A holding platform is provided to catch the exiting containers allowing an employee to load a container and receive a frosted container simultaneously.

The freezing chamber is formed integral with a flash freezing system capable of freezing moisture on glasses within the chamber in less than 60 seconds. The freezing system is comprised of a miniaturized refrigeration system based upon R-22 refrigerant gas. The evaporating coil is placed along the upper portion of the freezing chamber to improve the natural convection of cold air to circulate downward through the chamber.

Accordingly, it is a primary object of this invention to provide an energy efficient self-contained flash freezer for countertop placement next to rinsing stations providing a constant supply of frosted drinking glasses by frosting within 60 seconds of insertion.

Another object of the instant invention is to eliminate the need for large inventories of drinking glasses by providing an apparatus capable of reusing drinking glasses immediately upon insertion as well as eliminate the need for large inefficient freezers and their associated problems such as space consumption and injury to employees backs.

Yet another object of the instant invention is to teach the use of a sloped transfer roller bed providing ease of transfer from the insertion opening to the receipt opening with minimal insertion of an employees hand into the freezing chamber.

Still another object of the instant invention is to provide a stand-by mode for maintaining the temperature in the freezing chamber at about +30 degrees Fahrenheit during non-use so that the chamber can revert to flash freezing with minimum energy consumption and maintain frosted glasses for immediate use.

Still another object of the instant invention is to provide an apparatus sized to treat four, eight, twelve, or sixteen full size drinking containers with the ability to control water vapor for layering of frost on the drinking containers.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

PREFERRED EMBODIMENT OF THE INVENTION

Figure 1:
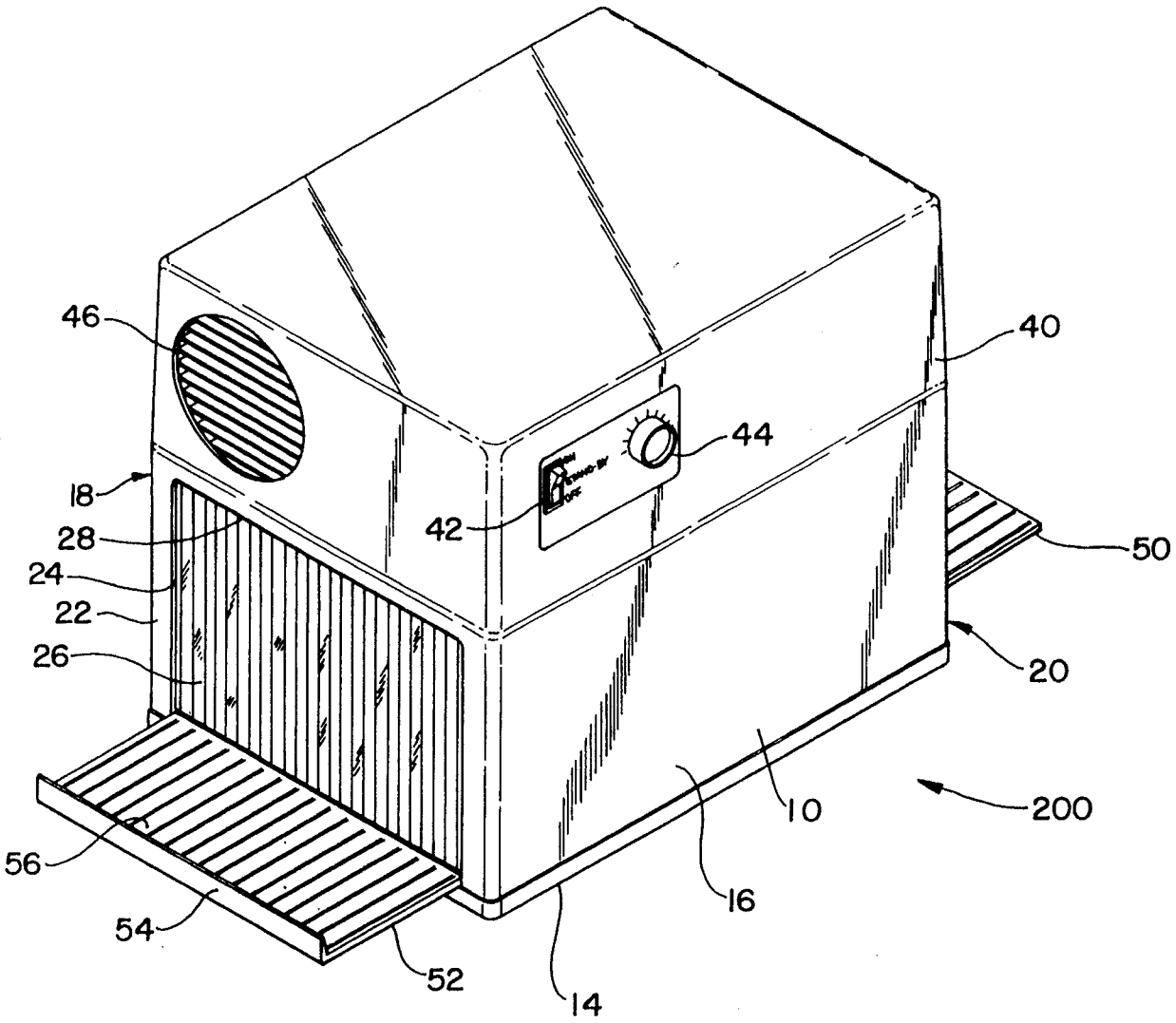
FIG. 1 is a perspective view of the instant invention.
Figure 7:
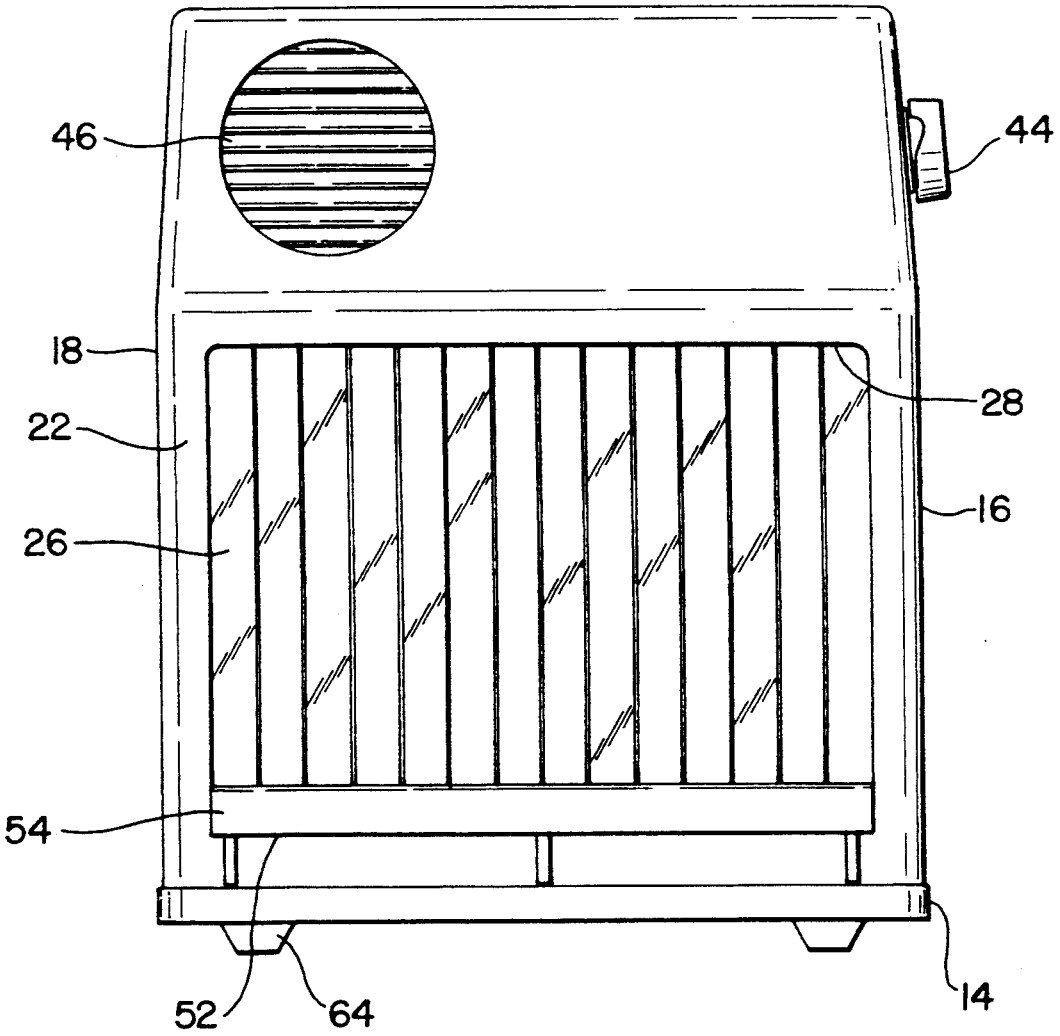
FIG. 7 is an end view of the instant invention illustrating hanging panels.

Now referring to FIGS. 1 and 7 of the drawings wherein like numerals represent like elements, disclosed is the countertop apparatus 200 for frosting drinking glasses of the instant invention. Weighing less than 25 pounds the apparatus is light enough for placement on conventional countertops and capable of taking the moisture on a glass from +75 degrees F. to about −30 degrees F. in about 60 seconds. A freezing chamber 10 of the apparatus is formed by a rectangular shaped housing defined by an insulated upper wall 12 and adjoined to insulated bottom wall 14 by two insulated side walls 16 & 18 and a first end wall 20 and a second end wall 22. The first end wall includes an insertion opening. The second end wall 22 has an opening 24 sized for accessing frosted drinking glasses placed within the freezing chamber 10 for removal therefrom. The opening 24 utilizes a plurality of insulating vinyl strips 26 hanging from a top edge 28 of the opening for retaining cold air within the chamber 10 yet providing ease of drinking glass removal. Another embodiment, described later in this specification, provides for the use of at least one hingedly attached door for sealing the opening 24. Similarly, first end wall 20, forms an offset mirror image of the second end wall having an opening 30 sized for insertion of drinking glasses into the freezing chamber 10. The opening has a plurality of insulating vinyl strips 32 hanging from a top edge 34 of said opening.

A means for lowering the temperature, numeral 40, in the freezing chamber 10 is provided by a miniaturized electric refrigeration system formed integral with the upper wall 12 of the apparatus 200. A power on/off switch 42 is provided on a side surface 16 for initiating and terminating the action of the refrigeration system. When the switch is in the "on" position, the temperature within the freezing chamber 10 is lowered to about −30 degrees Fahrenheit, the mechanics of the refrigeration system is explained in detail later in this specification. Once the freezing chamber 10 is stabilized at its operation environment, a drinking glass can be frosted in about 60 seconds. If a drinking glass remains in the freezing chamber 10 longer than 60 seconds, successive layers of frost can be applied depending upon the amount of moisture allowed within the chamber 10.

When the switch is in the "stand-by" position, the temperature within the freezing chamber 10 is maintained at about +30 degrees Fahrenheit. This mode is used when the apparatus is not in use such as when the establishment is closed. In this mode, a drinking glass can be frosted in about 1 hour, similar to that of a conventional freezer. In particular, this allows the freezing chamber 10 to stay cold during off hours providing less time for start-up and maintaining storage of frosted drinking glasses for immediate use if needed. A thermometer 44 provides a simplified indication of operation by display of the internal temperature of the freezing chamber. Grill 46 provides ventilation for a condenser coil without distracting from the apparatus 200 overall aesthetic appeal.

To accommodate insertion of drinking glasses into the freezing chamber 10, a loading support tray 50 attached to insertion side wall 20 allows placement of drinking glasses external the freezing chamber 10 if the freezing chamber is fully occupied. Similarly, tray 52 attached to end wall 22 slidably receives drinking glasses transferred through the freezing chamber 10 having a raised end 54 to prevent glasses from sliding off the apparatus.

Figure 2:
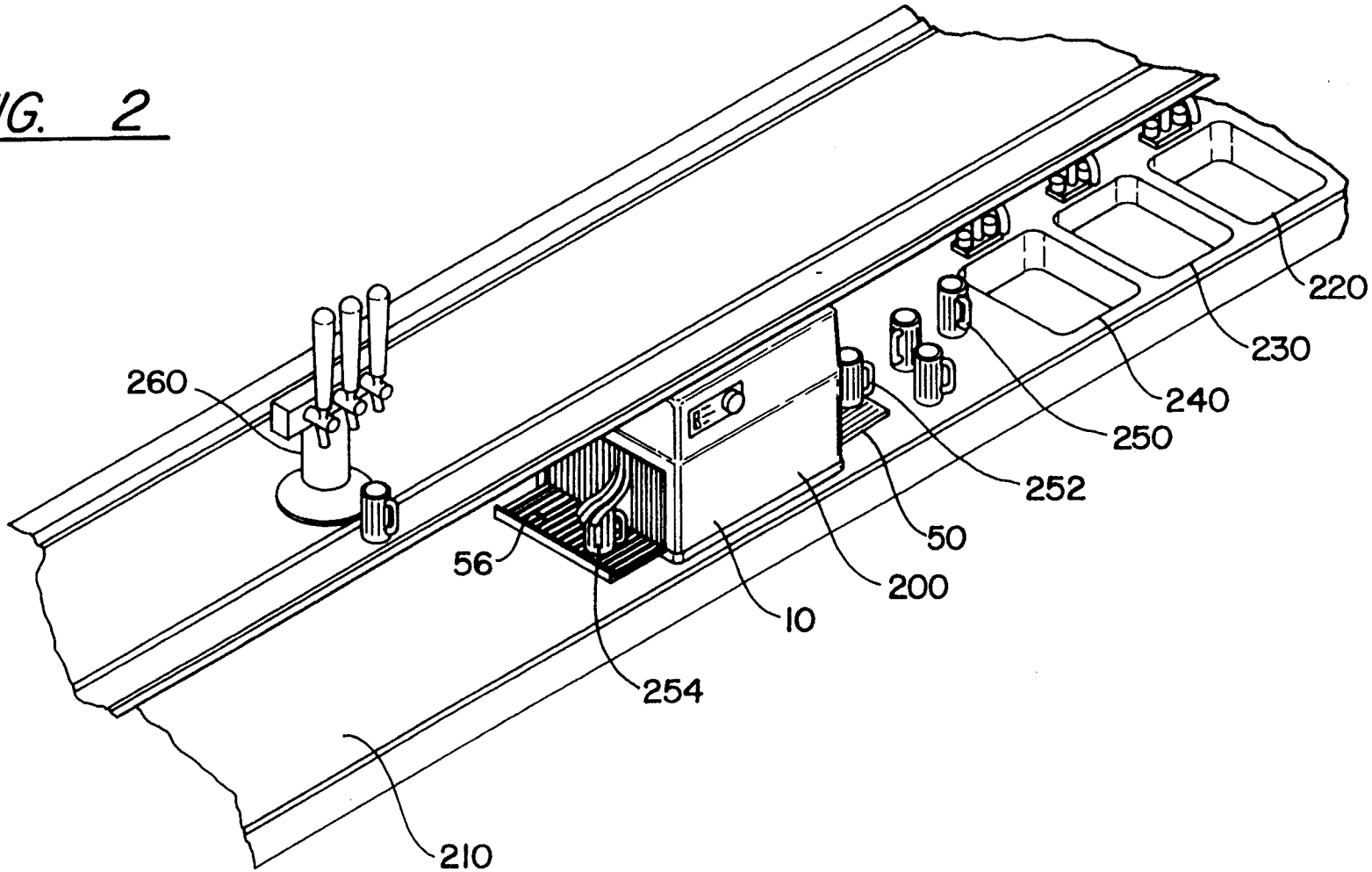
FIG. 2 is a pictorial view of the instant invention placed in a preferred restaurant countertop location.

Referring to FIG. 2, a pictorial view sets forth a typical installation of the apparatus 200 on the countertop 210 of a drinking establishment illustrating the wash sink 220, dip sink 230, and rinse sink 240. In operation, when a patron is finished with a drinking container, an employee can wash the glass in the sink 220, dip the glass in sink 230 to sterilize the drinking glass by the use of hot water before a final rinse in sink 240. The drinking glasses 250 can be set on the countertop 210, placed on the loading tray 50, or inserted directly into the freezing chamber 10. If a drinking glass 252 is pushed into the freezing chamber 10 while the chamber is full, a frosted drinking glass 254 will slide out of the freezing chamber onto receiving tray 52. Ribs 56 on the receiving tray 52 are raised allowing the frosted drinking glass 254 to slide without friction to the raised end 54 by pushing through the vinyl strips 26. The weight of the vinyl strips 26 will cause them to return to their original closed position as the frosted glass 254 slides away from the opening 24, the frost providing a frictionless surface. The frosted glass is then available for filling as shown with the draft fillers 260 or with any other beverage.

Figure 3:
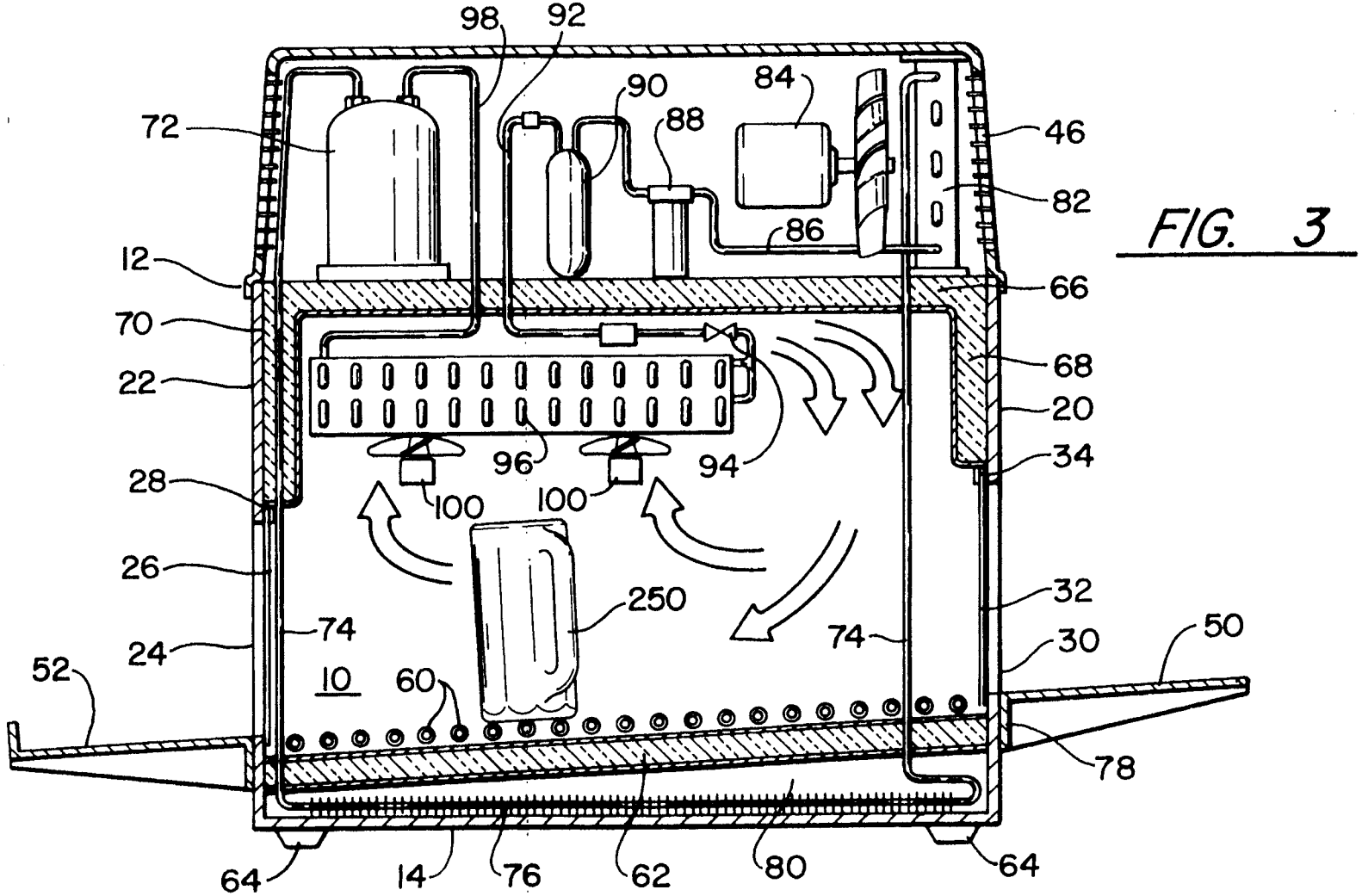
FIG. 3 is a cross sectional back side view.

FIG. 3 depicts a cross-sectional back side view of the apparatus illustrating the loading shelf 50 leading into a means for transferring the drinking glasses through the freezing chamber 10 to the receiving shelf 52. The base of the freezing chamber 10 is formed from a plurality of spaced apart free wheeling rollers 60 having free ends coupled to each side wall placing the rollers perpendicular to the end walls 20, 22 respectively. An angular pitch, having a slope less than 10 degrees, provides directional flow of the drinking glass 250 toward the receipt shelf 51. Directly beneath the rollers 60 is an insulation panel 62 constructed of 1 inch thick urethane or the like for retaining the cold air within the chamber. Alternatively, the insulating panel can be made a part of the lower wall 14 as explained later. Rubber feet 64 provide vibration dampening when placed upon the countertop. An insulation panel 66 can be further found on the upper wall 12 and on both side walls, not shown. The first end wall 20 includes a top portion having insulation panel 68 over opening 30 with insulating vinyl strips 32 depending from the top 34 of the opening 30. The second end wall 22 includes a top portion having insulation panel 70 over opening 24 with insulating vinyl strips 26 depending from the top 28 of the opening 24. As clearly depicted by the drawing, opening 30 is at a higher elevation than opening 24 accommodating the angular pitch and further providing room for a cooling coil forming a part of the refrigeration system for lowering the temperature.

The means for lowering the temperature in the freezing chamber 10 is based upon a small, lightweight refrigerator system using a compressor 72 operating on 115 voltage for compressing refrigerant gas such as R-22 for delivery to a condenser 82 by use of transfer tubing 74. The compressor is sized according to the size of the apparatus and can be mounted on top of the freezing chamber or mounted remotely therefrom. It has been found that the apparatus can be sized to handle four, eight, twelve or sixteen mugs for optimum efficiency. A twelve mug frosting apparatus employs a $\frac{1}{4}$ horsepower compressor motor drawing approximately 5 amps with the evaporator fan operating. As the compressor compresses the gas its by-product is heat which is used for melting ice formation along the inner surface of the bottom wall 14. To prevent warming of the freezing chamber, the tubing transfer line 74 is placed within side paneling 70 for delivery beneath the roller base insulation 62. Fins 76 associated with the tubing 74 provides radiant convection of the tubing heat forming a heating zone 80. The rollers 60 are spaced apart so as to allow the water to drop to drain holes, not shown, along the length of the lower insulating panel 62 to provide drainage of excess water into the heating zone 80.

In addition to the prevention of water freezing along the bottom pane, the heated tubes vaporize the water adding moisture to the freezing chamber for adding successive layers of frost. Vents 78 located beneath the loading tray 50 prevent heavy frosting by allowing evaporation to occur outside the apparatus. Placement of drinking glasses onto the loading shelf 50 are permitted to drain directly into the heating zone 80 if vents 78 are closed. Thus, if heavily frosted glasses are desired, vents 78 are closed and freshly rinsed glasses are placed directly onto the loading shelf wherein excess moisture drains into the heating zone 80 for distribution into the freezing chamber 10. If heavy frosting is not desired, the vents are open so that excess water from the shelf 50 drains onto the countertop, excess moisture in the heating zone is vented outside the apparatus, and frosting is dependent upon the incoming air moisture. Opening of the vent in various positions provides various levels of frosting. The condenser 82 is a conventional finned radiator used for condensing the refrigerant gas into a liquid refrigerant, cooling fan 84 ventilates the condenser coil and exhausts through grill 46. It should be noted that the cooling fan 84 can be undersized as the majority of the heat from the compressed gas is cooled during its travel along the heating zone 80. The liquid refrigerant is transferred through coupling line 86 to dryer 88 and stored in liquid accumulator 90. The accumulator 90 is followed by a capillary tubing 92 and/or a needle valve 94 for metering of the stored liquid refrigerant into an evaporator coil 96.

The evaporator coil 96 is mounted along the top of the freezing chamber 10 taking advantage of cold air droppage. The evaporator coil 96 vaporizes the liquid refrigerant absorbing heat from the freezing chamber. In operation, the compressor 72 raises the pressure of the refrigerant to about 210 psi in a vapor state so that its saturation temperature is higher than the temperature of the available cooling medium further causing a heat rise in the transfer tubing 74 and subsequent condensation. The refrigerant is condensed by circulating air past the condenser coil 82 causing sufficient heat loss through condensation for storage in an accumulator. The high pressure liquid is then metered causing a drop in pressure wherein the liquid refrigerant cools itself within the evaporator coil, the pressure may drop to 5 psi for suction 98 to the compressor 72. Fans 100 circulate the air throughout the freezing chamber 10 as shown by the direction arrows delivering the warmer air across the evaporator coil 96. When the switch 42 is in the on position, the compressor motor is energized together with dryer 88 allowing the pressure to rise in the system. Evaporator fans 100 and compressor fan 84 operates until the temperature in the freezing chamber reaches −30 F. degrees wherein the unit will pump down turning off the compressor fan 84, while the evaporator fans 100 continue to run.

Figure 4:
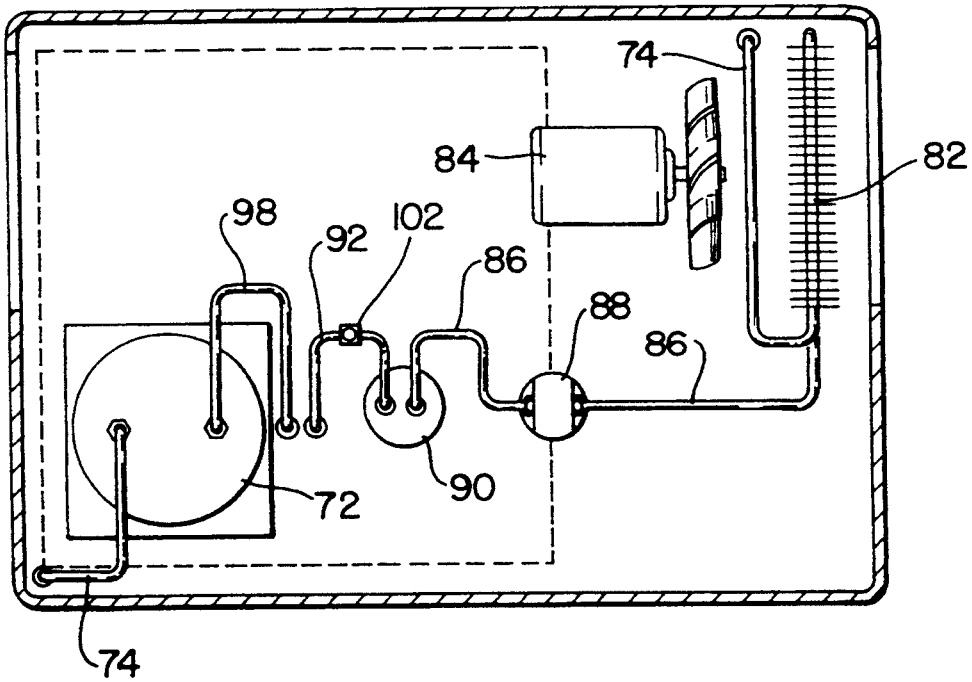
FIG. 4 is a cross sectional top view illustrating the cooling system of the instant invention.
Figure 5:
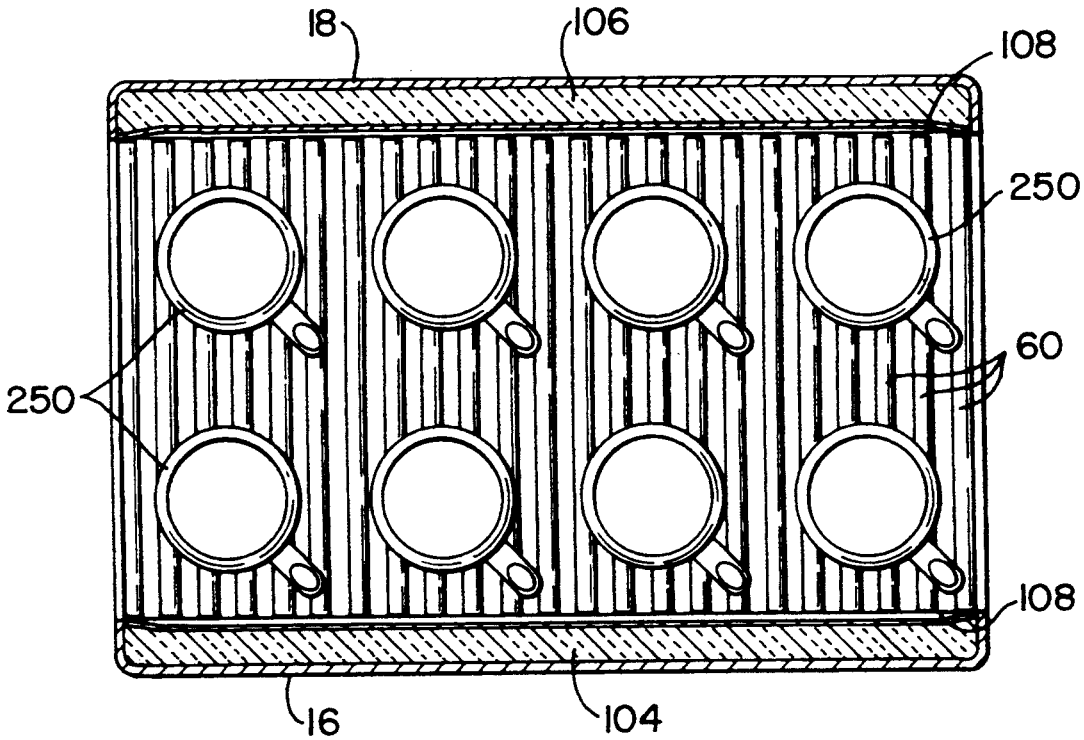
FIG. 5 is a cross sectional top view illustrating the placement of containers on the transfer mechanism.

FIG. 4 is a top cross section view illustrating the layout of the refrigeration system 40 with compressor 72 having high pressure line 74 leading to condenser radiator 82 and fan 84 combination. The condenser fluidly coupled to dryer 88 by tubing 86 followed by the liquid accumulator 90. Accumulator 90 leads to the evaporator coil by means of tubing 92 with sight glass 102 for visual check of loss of refrigerant. Suction line 98 pulls from the evaporator coil back to the compressor 98. FIG. 5 illustrates the roller base beneath the refrigeration system depicting eight beer mugs 250 placed upon the spaced apart rollers 60. Side wall 16 includes insulation panel 104, side wall 18 includes insulation panel 106. Runner 108 maintain the mugs 250 on the rollers 60.

Figure 6:
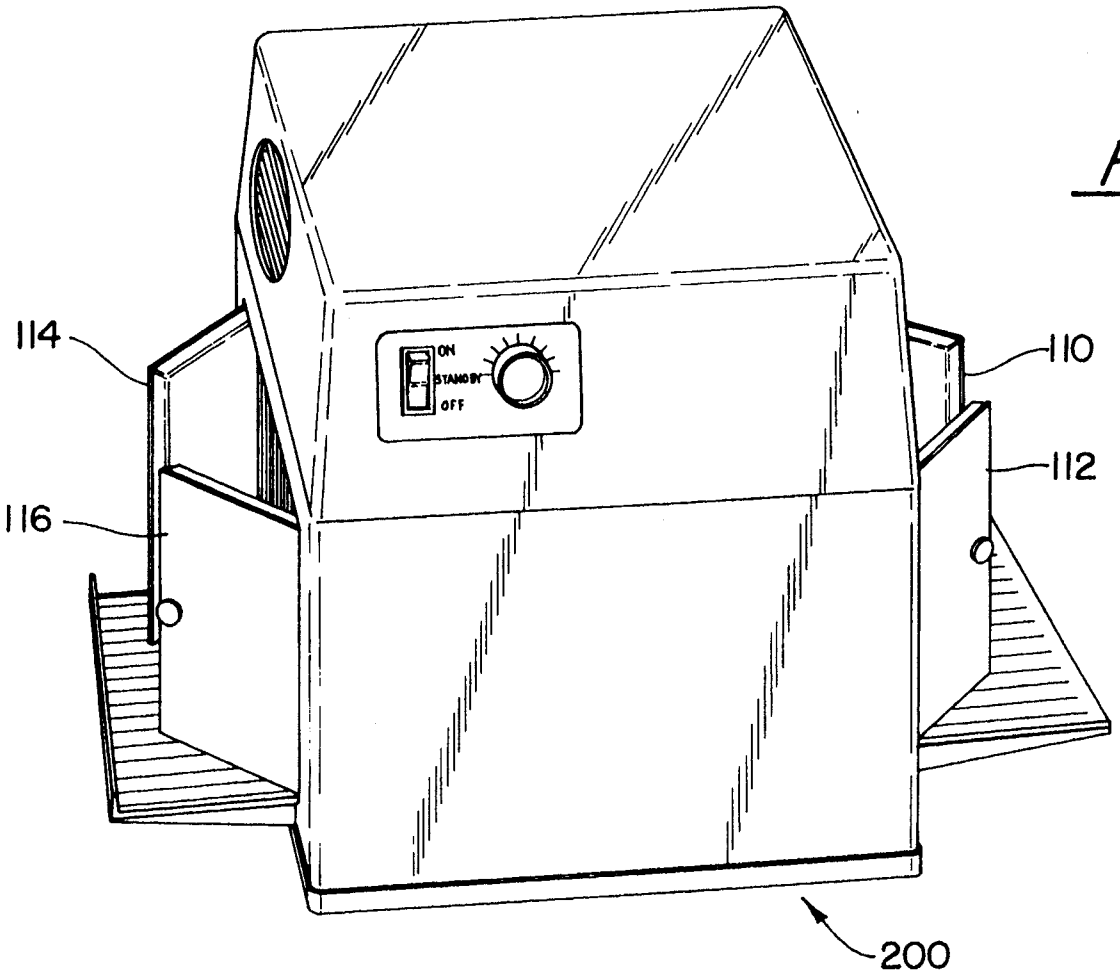
FIG. 6 is a perspective view of another embodiment of the invention using hinged doors.

FIG. 6 sets forth an alternative embodiment wherein the apparatus 200 utilizes hingedly attached doors 110, 112 for sealing the insertion opening. The exit can also include attached doors 114, 116 for sealing the opening.

The invention has been shown and described herein in what is considered to be the most practical and preferred embodiment. It is recognized, however, that departures may be made therefrom within the scope of the invention and that obvious modifications will occur to a person skilled in the art.

What is claimed is:

1. A countertop apparatus for frosting drinking glasses comprising:

a freezing chamber defined by an upper wall adjoined to a bottom wall by two side walls and a first and second end wall, said first end wall including a means for allowing insertion of drinking glasses into said chamber, said second end wall including a means for accessing said drinking glasses placed in said freezing chamber;

means for transferring drinking glasses between said first end wall and said second end wall;

means for lowering the temperature in said freezing chamber to a suitable temperature below the freezing temperature of water; and means for preventing frosting along the bottom wall by use of tubing fluidly coupled to said compressor for the transfer of heated liquid refrigerant beneath said transferring means, whereby said apparatus is positioned on a countertop for receipt of drinking glasses through said first wall and into said freezing chamber wherein said drinking glasses are frosted and made available for receipt through said second end wall.

2. The countertop apparatus according to claim 1 wherein said first end wall includes an opening sized for insertion of drinking glasses into said freezing chamber, said opening having a plurality of insulating vinyl strips hanging from a top edge of said opening.

3. The countertop apparatus according to claim 1 wherein said first end wall includes an opening sized for insertion of drinking glasses into said freezing chamber, said opening having at least one hingedly attached door for sealing said opening.

4. The countertop apparatus according to claim 1 wherein said second end wall includes an opening sized for accessing drinking glasses placed within said freezing chamber for removal therefrom, said opening having a plurality of insulating vinyl strips hanging from a top edge of said opening.

5. The countertop apparatus according to claim 1 wherein said second end wall includes an opening sized for accessing drinking glasses placed within said freezing chamber for removal therefrom, said opening having at least one hingedly attached door for sealing said opening.

6. The countertop apparatus according to claim 1 wherein said means for lowering the temperature in said freezing chamber comprises:

compressor means for compressing refrigerant gas;

condenser means fluidly coupled to said compressor means for condensing said refrigerant gas into a liquid refrigerant;

accumulating means fluidly coupled to said compressor means for accumulating said liquid refrigerant;

metering means fluidly coupled to said accumulating means allowing the liquid refrigerant in said accumulating means to escape through said metering means;

evaporating coil fluidly coupled to said metering means for receipt of said escaping liquid refrigerant for evaporation to produce a cooling effect, said evaporating coil fluidly coupled to said compressing means such that evaporated refrigerant can pass from said evaporating coil to said compressor means.

7. The countertop apparatus according to claim 1 wherein said means for transferring is further defined as a plurality of spaced apart free wheeling rollers having free ends coupled to each side wall placing said rollers perpendicular to said end walls with an angular pitch setting the rollers closest to the first end wall at a higher position than the rollers disposed closest to the second end wall.

8. The countertop apparatus according to claim 1 wherein said first end wall includes a means for supporting drinking glasses external said freezing chamber.

9. The countertop apparatus according to claim 1 wherein said second end wall includes a means for slidably receiving drinking glasses transferred through said freezing chamber.

10. The countertop apparatus according to claim 1 wherein said means for lowering the temperature is mounted above and made integral to said freezing chamber.

11. The countertop apparatus according to claim 6 wherein the evaporator coil is mounted along the top wall of said freezing chamber.

12. A countertop disposed apparatus for frosting drinking glasses comprising:

compressor means for compressing refrigerant gas;

condenser means fluidly coupled to said compressor means for condensing said refrigerant gas into a liquid refrigerant;

accumulating means fluidly coupled to said compressor means for accumulating said liquid refrigerant;

metering means fluidly coupled to said accumulating means allowing the liquid refrigerant in said accumulating means to escape through said metering means;

evaporating coil fluidly coupled to said metering means for receipt of said escaping liquid refrigerant for evaporation to produce a cooling effect, said evaporating coil fluidly coupled to said compressing means such that evaporated refrigerant can pass from said evaporating coil to said compressor means;

a freezing chamber defined by an insulated upper wall adjoined to an insulated bottom wall by two insulated side walls and a first and second end wall, said evaporating coil disposed within said chamber juxtapositioned to said upper wall and made available to lower the temperature in said freezing chamber to a suitable temperature below the freezing temperature of water;

means allowing insertion of drinking glasses through said first end wall;

means for transferring drinking glasses through said freezing chamber for receipt through said second end wall; and means for preventing frosting along the bottom wall by use of tubing fluidly coupled to said compressor for the transfer of heated liquid refrigerant beneath said transferring means, whereby said apparatus is positioned on a countertop for receipt of drinking glasses through said first wall into said freezing chamber wherein said drinking glasses are frosted as they are transfer though said chamber for receipt through said second end wall.

13. The countertop apparatus according to claim 12 wherein said freezing chamber can be regulated to a temperature of about −30 degrees Fahrenheit.

14. The countertop apparatus according to claim 12 wherein said means for transferring is further defined as a plurality of spaced apart free wheeling rollers having free ends coupled to each side wall placing said rollers perpendicular to said end walls with an angular pitch setting the rollers closest to the first end wall at a higher position than the rollers disposed closest to the second end wall.

15. A countertop apparatus for frosting drinking glasses comprising:

a freezing chamber defined by an upper wall adjoined to a bottom wall by two side walls and a first and second end wall, said first end wall including a means for allowing insertion of drinking glasses into said chamber, said second end wall including a means for accessing said drinking glasses placed in said freezing chamber;

means for transferring drinking glasses between said first end wall and said second end wall, said means for transferring including a plurality of spaced apart free wheeling rollers having free ends coupled to each side wall placing said rollers perpendicular to said end walls with an angular pitch setting the rollers closest to the first end wall at a higher position than the rollers disposed closest to the second end wall; and means for lowering the temperature in said freezing chamber to a suitable temperature below the freezing temperature of water, whereby said apparatus is positioned on a countertop for receipt of drinking glasses through said first wall and into said freezing chamber wherein said drinking glasses are frosted and made available for receipt through said second end wall.

* * * * *